US005883317A

United States Patent [19]

Kornprobst

[11] Patent Number: 5,883,317

[45] Date of Patent: Mar. 16, 1999

[54] DOUBLE-BACK ACOUSTIC BOOSTER FOR STRINGED INSTRUMENTS

[76] Inventor: Bernard P. Kornprobst, 1215 Louise St., Munhall, Pa. 15120

[21] Appl. No.: 911,831

[22] Filed: Aug. 15, 1997

[51] Int. Cl.[6] ..... G10D 3/02

[52] U.S. Cl. ..... 84/294

[58] Field of Search ..... 84/290, 291, 294, 84/296

[56] References Cited

U.S. PATENT DOCUMENTS

| | | | |
|---|---|---|---|
| 1,010,240 | 11/1911 | Degulio . | |
| 1,863,344 | 6/1932 | Lange . | |
| 1,881,229 | 10/1932 | Young . | |
| 2,260,066 | 10/1941 | Vitalis | 84/294 |
| 4,320,684 | 3/1982 | Podunavac | 84/291 |
| 4,823,668 | 4/1989 | Marrs | 84/296 |
| 4,903,567 | 2/1990 | Justus | 84/294 |

*Primary Examiner*—William M. Shoop, Jr.
*Assistant Examiner*—Jeffrey W. Donels
*Attorney, Agent, or Firm*—Webb Ziesenheim Bruening Logsdon Orkin & Hanson, P.C.

[57] ABSTRACT

A stringed instrument, such as an acoustic guitar, includes a sound board, a first back and a side positioned between the sound board and the first back. The sound board, the first back and the side cooperate to form a sound box. A second back is attached to the stringed instrument in spaced relation to the first back on a side of the sound box opposite the sound board. The second back creates a gap between the sound box and a musician playing the stringed instrument which reduces or eliminates muting and lessening of the string brilliance caused by contact between the first back and a musician playing the stringed instrument in the absence of the second back.

14 Claims, 5 Drawing Sheets

DOUBLE-BACK ACOUSTIC BOOSTER FOR STRINGED INSTRUMENTS

BACKGROUND OF THE INVENTION

The present invention relates generally to a musical instrument and more particularly to a stringed musical instrument, such as an acoustic guitar, having a resonating chamber.

Stringed musical instruments, such as acoustic guitars, typically include a sound board, a back and a side. The side extends between the perimeter of the sound board and the perimeter of the back and maintains the sound board and the back in spaced relation. The sound board, the back and the side cooperate to define a resonating chamber or sound box having one or more holes or apertures formed therein, preferably in the sound board, to enable sound waves to emerge from the sound box.

The stringed instrument includes a neck and a bridge secured to the sound box in a manner known in the art. The neck includes a head positioned at an end thereof opposite the sound box. In an acoustic guitar, the hole in the sound board is disposed between the neck and the bridge and strings are secured between the head and the bridge and over the hole in the sound board in a manner known in the art.

In a typical use, the back of the stringed instrument is held in contact with the body of the musician playing the stringed instrument. This contact between the stringed instrument and the musician prevents or inhibits vibration of the back of the instrument during the playing thereof which causes the sound produced thereby to be muted and the strings to have less "brilliance".

It is the object of the present invention to overcome these problems and others by providing a gap or air space between the back of the stringed instrument and the musician.

It is an object of the invention to provide a gap or air space between the side of the stringed instrument and the musician.

It is also an object of the invention to increase the effective size of the sound box.

SUMMARY OF THE INVENTION

Accordingly, I have invented a stringed instrument having a sound board, a first back positioned in spaced relation to the sound board and a first side wall extending between the sound board and the first back such that the first side wall, the sound board and the first back define a sound box. A second back is positioned in spaced relation to the first back on a side thereof opposite the sound board such that the first back and second back form a first gap therebetween. A spacer is positioned between the first back and the second back for maintaining the first gap therebetween. The first gap debouches laterally to the opposing faces of the first back and second back. A securing means is utilized to secure the first back and the second back in spaced relation. Preferably, the outlines and sizes of the first back and the second back are similar.

In another embodiment of the invention, a second side wall is positioned around the perimeter of the second back. The second side wall is positioned around the first side wall and in spaced relation therewith when the second back is positioned in spaced relation to the first back. The first side wall and the second side wall form a second gap therebetween that debouches away from the second back. Preferably the second gap extends substantially around the sound box.

In another embodiment of the invention, the spacer is a spacer band that is positioned between and substantially around the edge of the first back and the edge of the second back. The spacer band has a plurality of apertures formed therein. Each of the plurality of apertures may be the same size or may be different sizes.

An advantage of the present invention is that muting of the stringed instrument caused by contact between the body of the musician and the sound box is reduced or eliminated.

An advantage of the present invention is that the lessening of the string brilliance caused by contact between the body of the musician and the sound box is reduced or eliminated.

An advantage of the present invention is that the effective size of the sound box is increased by creating a megaphone affect.

Still other advantages will become apparent to those of ordinary skill in the art upon reading and understanding the following detailed description.

DETAILED DESCRIPTION OF THE PREFERRED EMBODIMENTS

Figure 1:
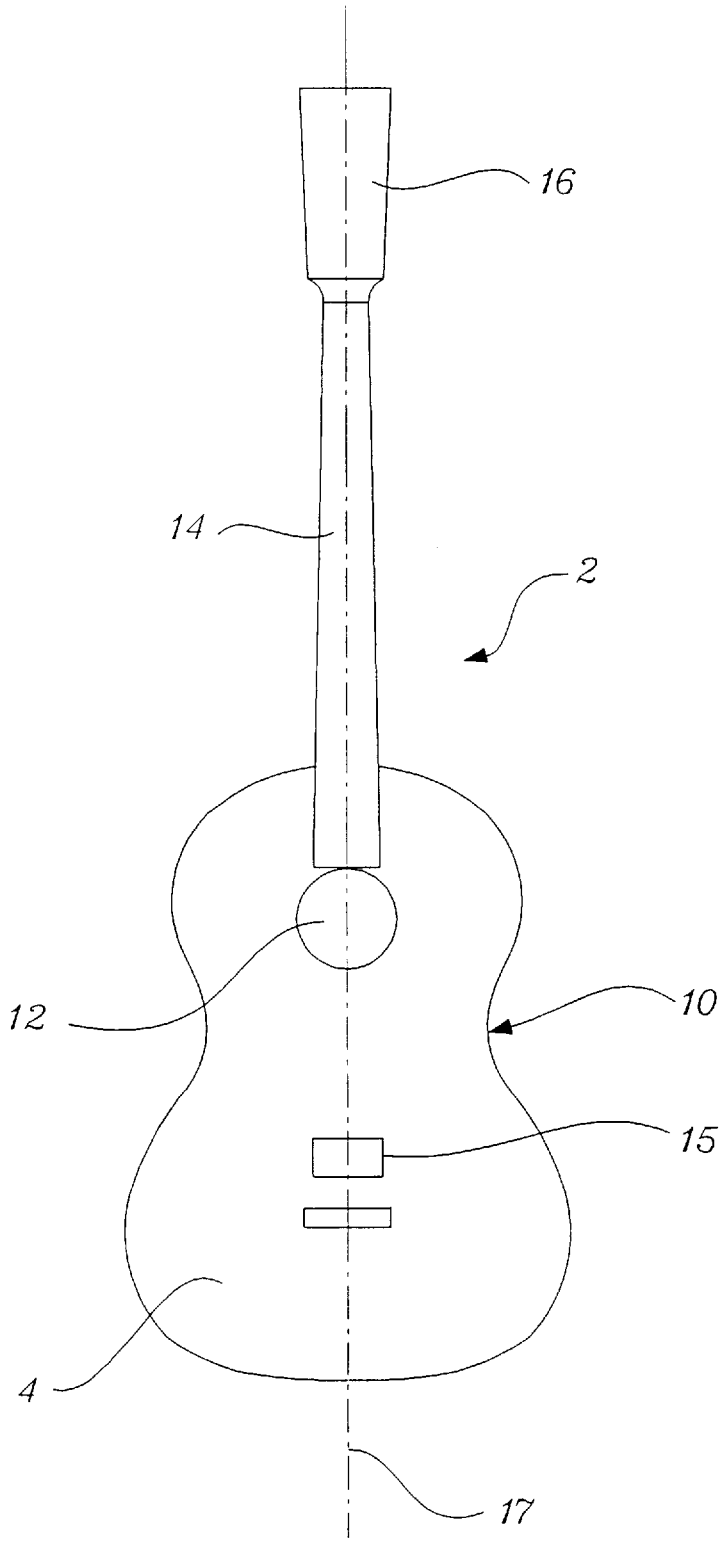
Fig.1. Prior Art
FIG. 1 is a plan view of a prior art acoustic guitar.
Figure 2B:
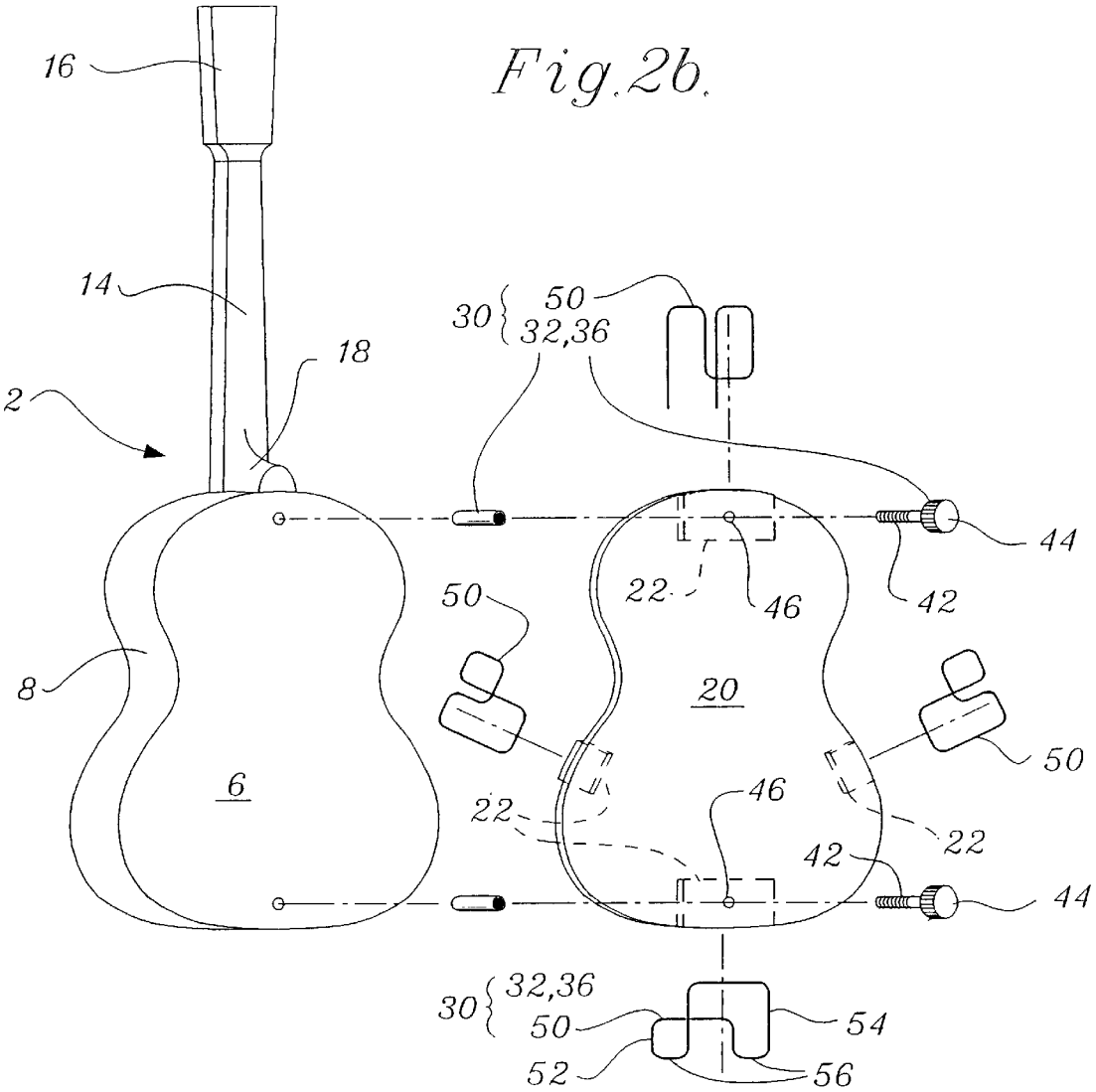
FIG. 2*b* is an exploded perspective view of the guitar and second back of FIG. 2*a;*
Figure 2A:
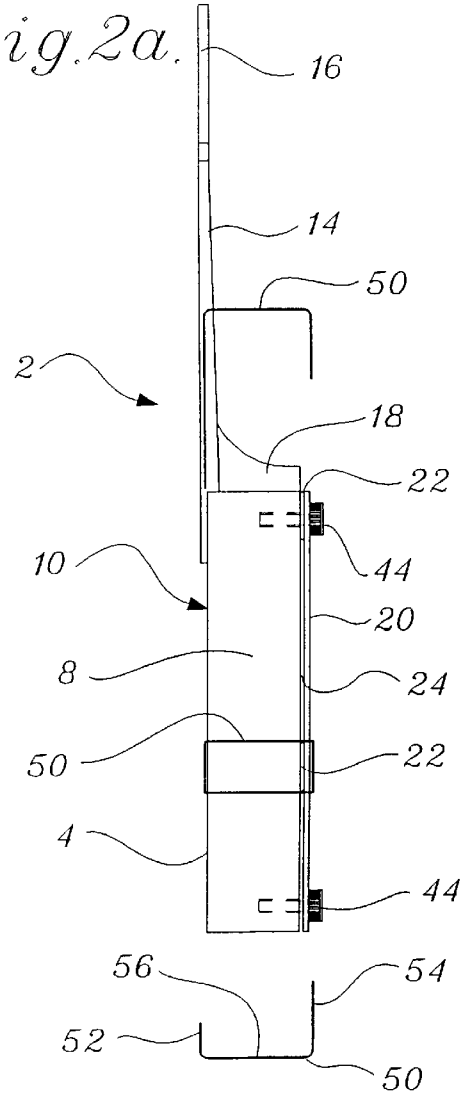
FIG. 2*a* is a side view of the prior art acoustic guitar in FIG. 1 including a second back of the present invention.

With reference to FIGS. 1, 2*a* and 2*b*, a stringed instrument 2, such as an acoustic guitar, typically includes a sound board 4, a first back 6 and a side wall 8 positioned therebetween and cooperating to form a sound box 10. Preferably, the sound board 4 has a hole 12 formed therein for the passage of sound therethrough. A neck 14 having a head 16 at an end thereof opposite the sound box 10 is attached to the sound box 10 and extends therefrom in a manner known in the art. A bridge 15 is positioned on the sound board 4 on a side of the hole 12 opposite the neck 14. The hole 12, the bridge 15 and the neck 14 are preferably aligned with a longitudinal axis 17 of the stringed instrument 2. Strings (not shown) are secured between the head 16 and the bridge 15 in a manner known in the art. A brace 18, preferably formed as an integral part of the neck 14, is utilized to secured the neck 14 to the side wall 8 thereby reinforcing the attachment of the neck 14 to the sound box 10.

An auxiliary, or second back 20, preferably having generally the same outline and size as the first back 6, is positioned in opposition in a spaced relation to the first back 6 on the side of the sound box 10 opposite the sound board 4. One or more spacers 22 positioned between the first back 6 and the second back 20, preferably around the peripheral edges thereof, are utilized to maintain the first back 6 and the second back 20 in the spaced relation thereby forming a first gap 24 therebetween that debouches laterally to the opposing faces of the first back 6 and the second back 20.

The size of the first gap 24 between opposing faces of the first back 6 and the second back 20 is preferably one-quarter of an inch. However, the size of the first gap 24 is not to be construed as limiting the invention.

One or more securing means 30 are utilized to secure the second back 20 in spaced relation to the first back 6. One embodiment of the securing means 30 includes an internally threaded bushing or nut 32 fixedly positioned in the sound box 10 adjacent the first back 6 and a threaded fastener 36, e.g., a thumb screw, having a threaded end 42 and a headed end 44. The threaded end 42 of the thumb screw 36 is adapted to be threadedly received in and mate with the internal threads of the threaded bushing 32. Preferably, the headed end 44 of the thumb screw 36 is of sufficient size to be manually finger rotated.

To secure the first back 6 and second back 20 in spaced relation, the first back 6 and second back 20 are positioned such that a hole 46 formed through spacer 22 and the second back 20 is aligned with the threaded bushing 32 disposed in the sound box 10. The threaded end 42 of a thumb screw 36 is projected through the hole 46 and into threaded mating engagement with the internal threads of the threaded bushing 32. The headed end 44 is manually finger rotated until the thumb screw 36 is tightened to a desired extent.

Another embodiment of the securing means 30 includes one or more generally U-shaped spring clips 50 utilized to secure the second back 20 in spaced relation to the first back 6. Each spring clip 50 preferably includes a first pair of leg members 52 connected to a second pair of leg members 54 by a pair of base members 56 extending therebetween. Each spring clip 50 is adapted so that the first pair of leg members 52 engage the exposed surface of the sound board 4, the second pair of leg members 54 engage the surface of the second back 20 opposite the first back 6, and the pair of base members 56 extend between the sound board 4 and the second back 20 adjacent the side wall 8. The U-shaped spring clips 50 are adapted so that the ends of each pair of the first and the second leg members 52, 54 opposite the pair of base members 56 apply a compressive force therebetween.

When installed, the one or more U-shaped spring clips 50 apply a compressive force of sufficient extent to secure the second back 20 and the first back 6 in spaced relation. Preferably, the U-shaped spring clips 50 are attached between the sound board 4 and the second back 20 and in alignment with the spacers 22 which avoid undesired bending or flexing of the second back 20 towards the first back 6 by the compressive force applied between the leg members 52, 54 of the U-shaped spring clips 50. The U-shaped spring clips 50 can be utilized either singly or in combination with the combination threaded bushing 32 and thumb screw 36 to secure the second back 20 and the first back 6 in spaced relation.

Figure 3A:
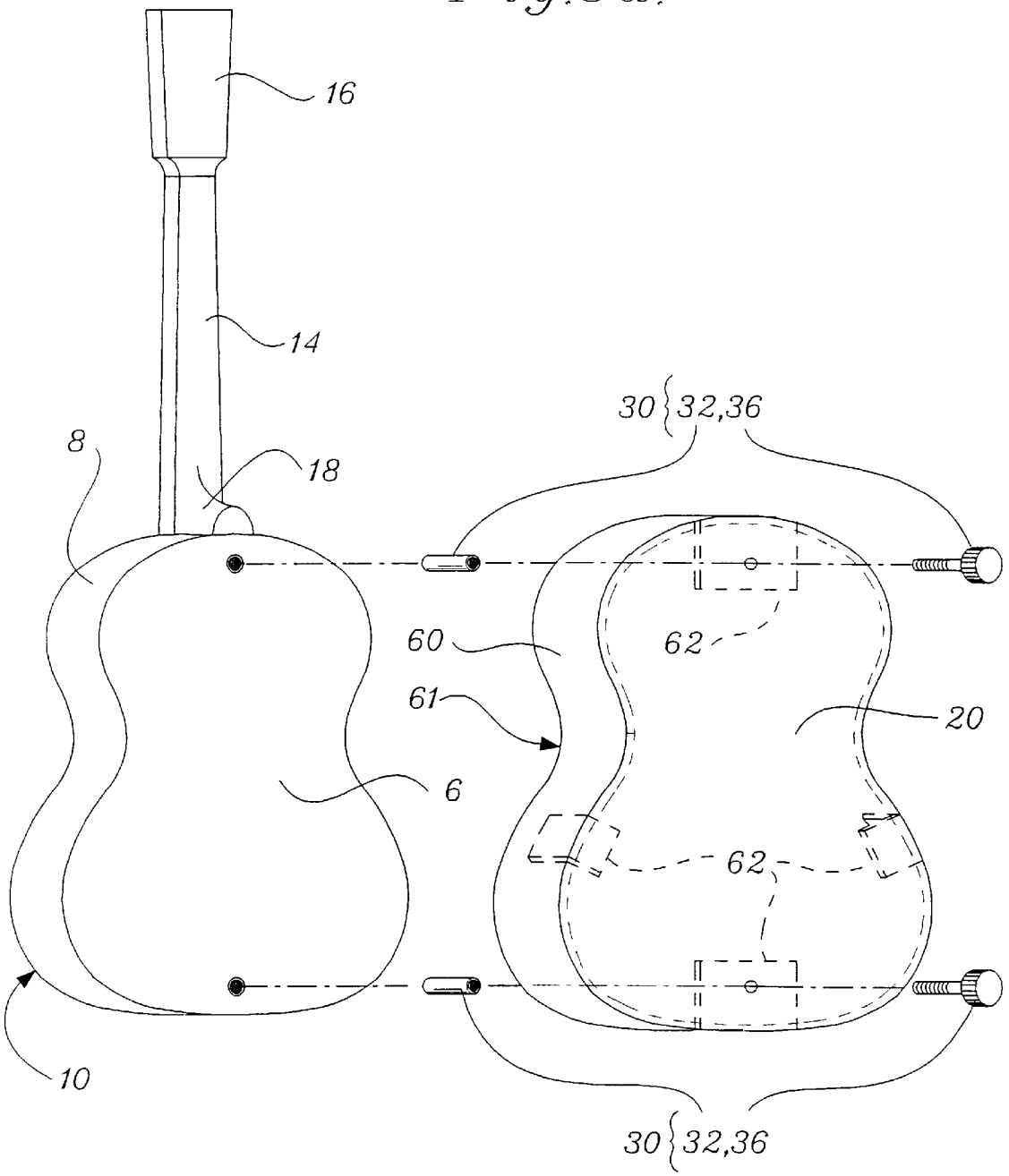
FIG. 3*a* is an exploded perspective view of the acoustic guitar of FIG. 1 and a shell type second back.

With reference to FIG. 3*a*, in another embodiment, a second side wall 60 is secured normal to a face of the second back 20 adjacent the perimeter thereof. The second side wall 60 and the second back 20 cooperate to form a shell 61. Positioned between the second back 20 and the second side wall 60 and inside the shell 61 are a plurality of L-shaped spacers 62. In this embodiment, the first back 6 and the second back 20 have a similar outline, however, the size of the second back 20 is greater than the size of the first back 6. The greater size of the second back 20 enables the sound box 10 to be received in the shell 61. The spacers 62 positioned inside shell 61 enable the first back 6 and the second back 20, and the first side wall 8 and the second side wall 60 to be positioned in opposition in a spaced relation.

Figure 3B:
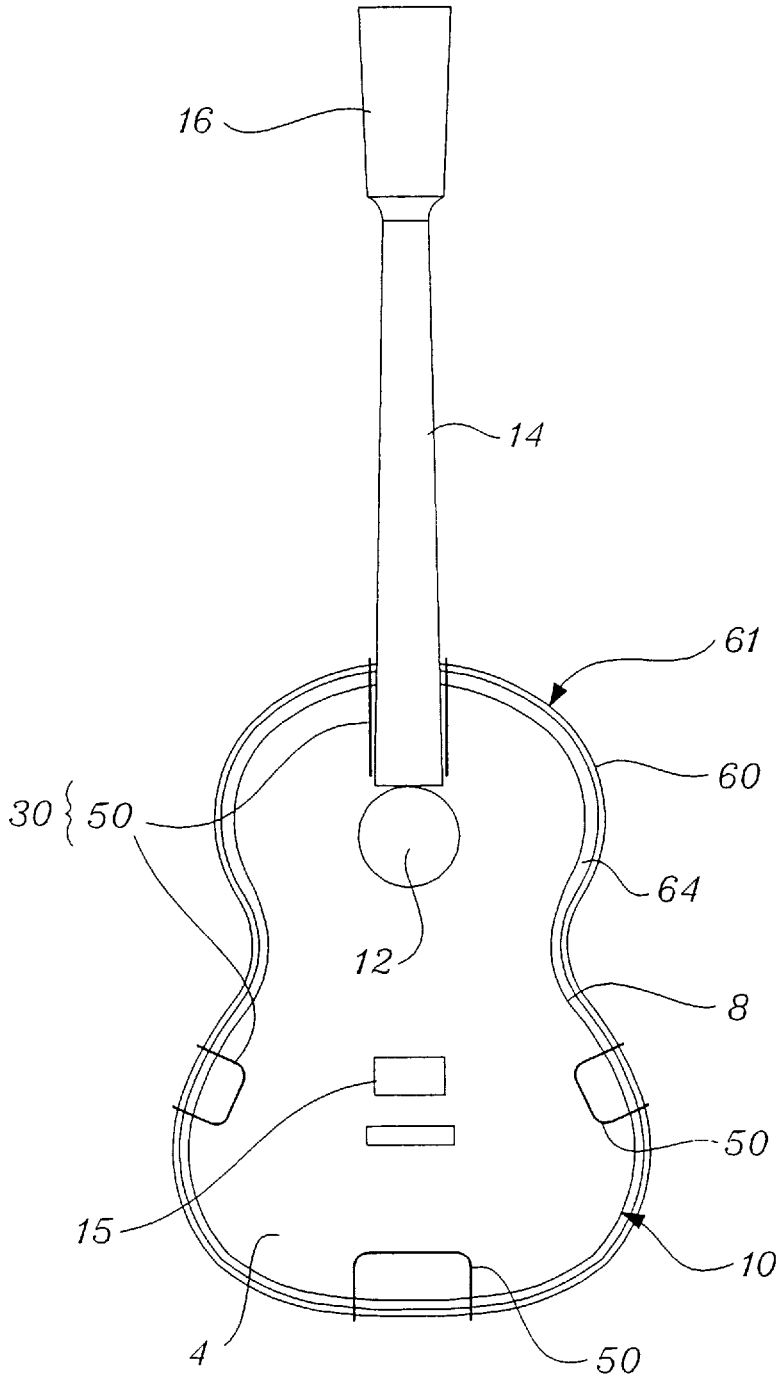
FIG. 3*b* is a plan view of the guitar having its sound box received within the shell type second back of FIG. 3*a;*

With reference to FIG. 3*b* and with continuing reference to FIG. 3*a*, like the embodiment shown in FIG. 2*b*, the spaced relation of the first back 6 and the second back 20 of the shell 61 forms the first gap 24 therebetween (not shown in FIGS. 3*a*, 3*b*). Moreover, the spaced relation of the first side wall 8 and the second side wall 60 of the shell 61 form a second gap 64 therebetween that debouches away from the second back 20. The second gap 64 is contiguous with the first gap 24. The second gap 64 and the first gap 24 form a resonating chamber between the shell 61 and the sound box 10. This resonating chamber is interrupted only by the L-shaped spacers 62 positioned between the shell 61 and the sound box 10. Like the embodiment shown in FIGS. 2*a* and 2*b*, one or more of securing means 30 are utilized to secure together the shell 61 and the sound box 10.

Figure 4B:
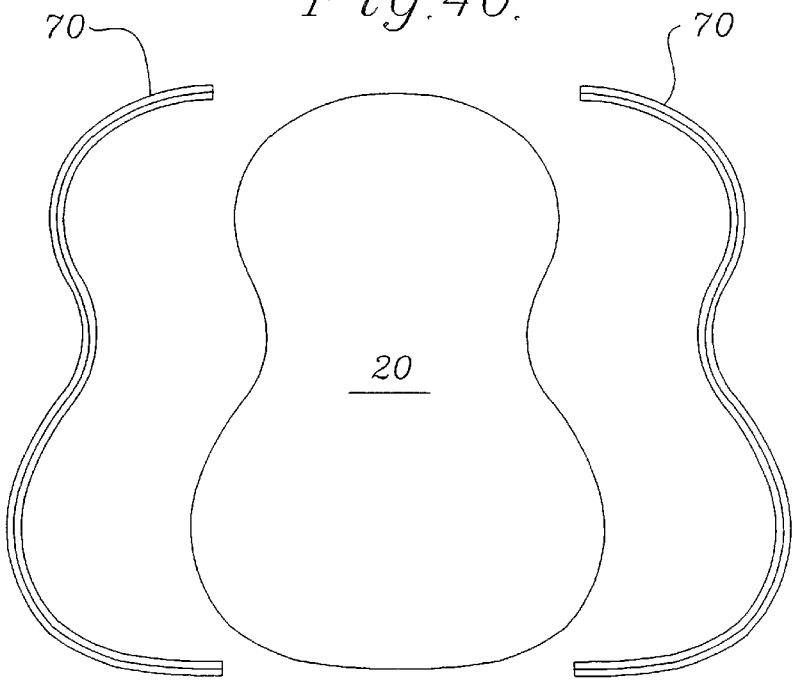
FIG. 4*b* is an exploded view of the second back with the spacer bands of FIG. 4*a* positioned on opposite sides thereof.
Figure 4A:
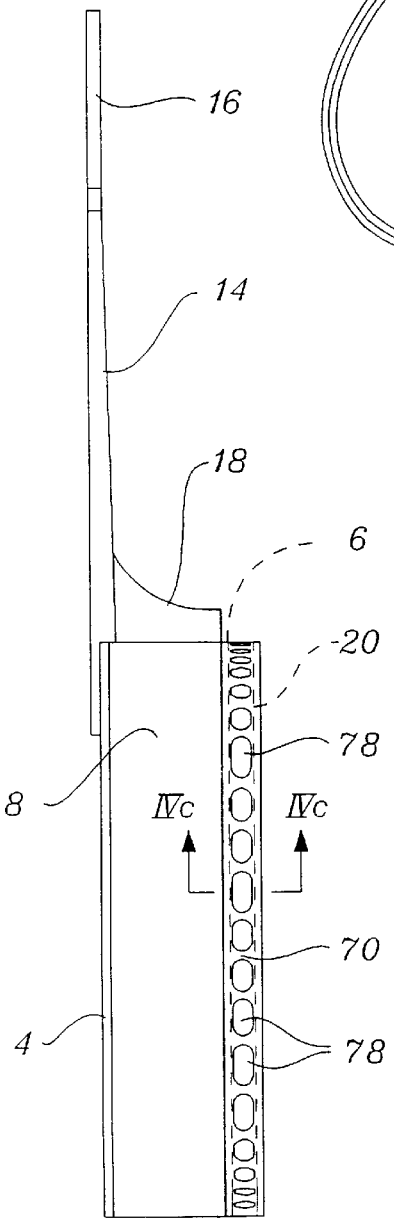
FIG. 4*a* is a side view of an acoustic guitar including a tuned-port spacer band positioned between a perimeter of the first back thereof and a perimeter of a second back.
Figure 4C:
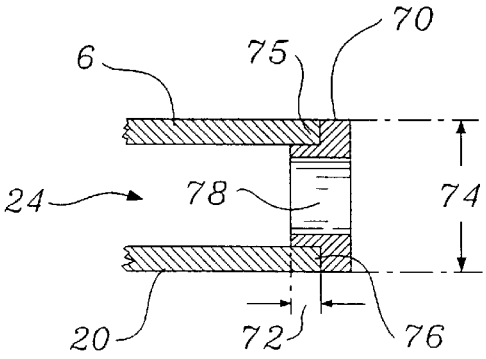
FIG. 4*c* is a cross-sectional view, taken along the lines IVC—IVC of FIG. 4*a*, of the spacer band positioned between the back of the acoustic guitar and the second back in FIG. 4*a*.

With reference to FIGS. 4*a*–4*c*, in another embodiment, one or more tuned-port spacer bands 70 are utilized to position the first back 6 and the second back 20 in opposition in a spaced relation. Each spacer band 70 has a T-shaped cross-section having a leg portion 72 and a head portion 74. As shown in FIG. 4*c*, each spacer band 70 is positionable such that the leg portion 72 is sandwiched between the first back 6 and the second back 20 and the head portion 74 extends between and overlays a peripheral edge 75 of the first back 6 and a peripheral edge 76 of second back 20. The leg 72 maintains the spaced relation between the first back 6 and the second back 20 thereby forming the gap 24 therebetween. The sides of the head 74 overlaying the peripheral edge 75 of the first back 6 and the peripheral edge 76 of the second back 20 maintain lateral alignment therebetween.

Each tuned-port spacer band 70 includes a plurality of apertures 78 formed therein at locations that are, preferably, unobstructed when the tuned-port spacer band 70 positions the first back 6 and the second back 20 in spaced relation. Preferably, the size of each aperture is "tuned" to a desired frequency or band of frequencies produced by the stringed instrument. In this respect, the apertures 78 may be formed having one size or a plurality of different sizes.

The second back 20, shown in the embodiment of FIGS. 2*a*–2*b*, provides a gap 24 between the stringed instrument 2, such as an acoustic guitar, and the body of a musician (not shown) playing the stringed instrument 2. This gap 24 reduces or eliminates muting of the stringed instrument 2 caused by contact between the body of the musician and the sound box 10, and specifically the first back 6, of the stringed instrument 2 and enables the sound box 10 to "breathe". The gap 24 also reduces or eliminates the lessening of the string brilliance of the stringed instrument 2 caused by contact between the body of the musician and the sound box 10. The shell 61, shown in the embodiment of FIGS. 3*a*–3*b*, enables the effective size of the sound box 10 of the stringed instrument 2 to be increased by creating a "megaphone" effect that increases the volume, and eliminates or reduces muting and lessening of the string brilliance of the stringed instrument 2. Lastly, the tuned-port spacer band 70, shown in the embodiment of FIGS. 4*a*–4*c*, enables the sound box 10 to "breathe", and reduces or eliminates muting of the body resonance and lessening of string brilliance of the stringed instrument 2.

The invention has been described with reference to the preferred embodiments. Obvious modifications and alterations will occur to others upon reading and understanding the preceding detailed description. For example, instead of being planar the first back 6 and/or the second back 20 could be arcuate shaped. Moreover, the first back 6 and the second back 20 could be designed to have different shapes so that the size of the first gap 24 and/or the second gap 64 therebetween is variable. It is intended that the invention be construed as including all such modifications and alterations insofar as they come within the scope of the appended claims or the equivalents thereof.

Having thus described the preferred embodiments, the invention is now claimed to be:

1. A stringed instrument comprising:

a sound board;

a first back positioned in spaced relation to the sound board;

a first side wall positioned between the sound board and the first back such that the first side wall, the sound board and the first back define a sound box; and a second back positionable in spaced relation to the first back on a side thereof opposite the sound board such that the first back and the second back form a first gap therebetween.

2. The stringed instrument as set forth in claim 1, further including a spacer positioned between the first back and the second back for maintaining the first gap therebetween.

3. The stringed instrument as set forth in claim 1, wherein the first gap debouches laterally to the opposing faces of the first back and the second back.

4. The stringed instrument as set forth in claim 2, wherein the spacer is positioned adjacent the peripheral edge of the first back and the peripheral edge of the second back.

5. The stringed instrument as set forth in claim 1, wherein the distance of the first gap between opposing faces of the first back and the second back is approximately one-quarter of an inch.

6. The stringed instrument as set forth in claim 1, further including a securing means for securing the second back in spaced relation to the first back.

7. The stringed instrument as set forth in claim 6, wherein the securing means includes at least one of:

(i) a spring clip adapted to secure the second back in spaced relation to the first back; and (ii) a threaded fastener adapted to project through a hole formed in the second back and mate with a threaded bushing secured to the sound box.

8. The stringed instrument as set forth in claim 1, wherein at least one of the outline and size of the first back and the second back are one of identical and similar.

9. The stringed instrument as set forth in claim 4, wherein:

the spacer is a spacer band that is positioned at least partially around a peripheral edge of the first back and a peripheral edge of the second back; and the spacer band has a plurality of apertures formed therein.

10. The stringed instrument as set forth in claim 9, wherein the plurality of apertures includes a first aperture having a first size and a second aperture having a second size different from the first size.

11. The stringed instrument as set forth in claim 1, further including a second side wall positioned on the second back and positionable around the first side wall and in spaced relation therewith when the second back is positioned in spaced relation to the first back, the first side wall and the second side wall forming a second gap therebetween that debouches away from the second back.

12. The stringed instrument as set forth in claim 11, further including a brace positioned between the first side wall and a neck of the stringed instrument positioned adjacent the sound board, wherein the second side wall includes a slot adapted to receive the brace when the second side wall is positioned around the first side wall.

13. The stringed instrument as set forth in claim 11, wherein the second gap extends substantially around the sound box.

14. The stringed instrument as set forth in claim 11, wherein the first gap and the second gap are contiguous and form a resonating chamber between the sound box and a shell formed by the second back and the second side wall.

* * * * *